US007988828B2

(12) United States Patent
Hermans et al.

(10) Patent No.: US 7,988,828 B2
(45) Date of Patent: Aug. 2, 2011

(54) SURFACE TREATING TISSUE WEBS VIA PATTERNED SPRAYING

(75) Inventors: Michael Alan Hermans, Neenah, WI (US); Patrick Pachih Chen, Appleton, WI (US); Claudia H. Javenkoski, Appleton, WI (US); Robert Eugene Krautkramer, Combined Locks, WI (US); Daniel Robert Sprangers, Kaukauna, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 339 days.

(21) Appl. No.: 12/286,364

(22) Filed: Sep. 29, 2008

(65) Prior Publication Data

US 2010/0078141 A1 Apr. 1, 2010

(51) Int. Cl.
*D21H 23/50* (2006.01)
*D21F 11/00* (2006.01)

(52) U.S. Cl. ..... 162/184; 162/134; 162/135; 162/204

(58) Field of Classification Search ..... 162/134–137, 162/183–184, 204; 239/7–8, 103, 145, 533.1, 239/589, 726–727; 427/361, 391, 421.1, 427/424–425; 118/300, 303, 317–318, 323–325, 118/427.1; 428/195.1
See application file for complete search history.

(56) References Cited

U.S. PATENT DOCUMENTS 2,862,251 A * 12/1958 Kalwaites ..... 264/119
3,274,018 A * 9/1966 Russell et al. ..... 427/275
3,556,932 A 1/1971 Coscia et al.
3,556,933 A 1/1971 Williams et al.
3,700,623 A 10/1972 Keim et al.
3,772,076 A 11/1973 Keim
4,016,317 A * 4/1977 Kalwaites ..... 428/88
4,021,284 A * 5/1977 Kalwaites ..... 156/277
4,116,762 A * 9/1978 Gardiner ..... 162/199
4,228,123 A * 10/1980 Marshall ..... 264/557
4,276,681 A * 7/1981 Marshall ..... 28/105
4,297,404 A * 10/1981 Nguyen ..... 428/85
4,326,000 A 4/1982 Roberts, Jr.

(Continued)

FOREIGN PATENT DOCUMENTS

EP 0 749 509 B1 11/2000

(Continued)

OTHER PUBLICATIONS

TAPPI Official Test Method T 402 om-93, "Standard Conditioning and Testing Atmospheres for Paper, Board, Pulp Handsheets, and Related Products," published by the TAPPI Press, Atlanta, Georgia, revised 1993, pp. 1-3.

(Continued)

*Primary Examiner* — José A Fortuna
(74) *Attorney, Agent, or Firm* — Michael J. Sullivan; Gregory E. Croft

(57) ABSTRACT

Tissue webs, such as are useful for making bath tissue, can be surface-treated in a pattern with selected papermaking chemicals, such as debonders and strength agents, to selectively improve the directional properties of the resulting tissue product, particularly the cross-machine direction strength properties. The pattern can be applied to the tissue sheet by spraying the selected chemical outwardly through a pattern of open areas in the shell of a rotating hollow roll, where the pattern of open areas corresponds to the desired pattern of chemical deposited on the surface of the tissue web.

16 Claims, 7 Drawing Sheets

U.S. PATENT DOCUMENTS

| | | | | | |
|---|---|---|---|---|---|
| 4,666,390 | A | * | 5/1987 | Kenworthy et al. | 425/86 |
| 5,246,545 | A | | 9/1993 | Ampulski et al. | |
| 5,366,785 | A | | 11/1994 | Sawdai | |
| 5,474,689 | A | | 12/1995 | Laughlin et al. | |
| 5,569,326 | A | * | 10/1996 | Ruhl | 118/205 |
| 5,601,871 | A | | 2/1997 | Krzysik et al. | |
| 5,607,551 | A | | 3/1997 | Farrington, Jr. et al. | |
| 5,635,028 | A | | 6/1997 | Vinson et al. | |
| 5,672,248 | A | | 9/1997 | Wendt et al. | |
| 5,814,188 | A | | 9/1998 | Vinson et al. | |
| 5,830,317 | A | | 11/1998 | Vinson et al. | |
| 5,964,960 | A | * | 10/1999 | Boeck | 134/34 |
| 6,120,642 | A | | 9/2000 | Lindsay et al. | |
| 6,569,290 | B2 | | 5/2003 | Johnson | |
| 6,649,262 | B2 | * | 11/2003 | Hoo et al. | 428/364 |
| 6,651,924 | B2 | * | 11/2003 | Gingras et al. | 242/541.2 |
| 7,141,142 | B2 | | 11/2006 | Burazin et al. | |
| 7,461,438 | B2 | * | 12/2008 | Sommer et al. | 28/167 |
| 2005/0196538 | A1 | * | 9/2005 | Sommer et al. | 427/372.2 |
| 2006/0144539 | A1 | * | 7/2006 | Urlaub et al. | 162/135 |
| 2010/0078141 | A1 | * | 4/2010 | Hermans et al. | 162/204 |
| 2010/0239843 | A1 | * | 9/2010 | Luu et al. | 428/311.71 |

FOREIGN PATENT DOCUMENTS

| | | | | |
|---|---|---|---|---|
| EP | 1 023 498 | B1 | | 3/2003 |
| EP | 0 799 350 | B1 | | 6/2003 |
| EP | 1 112 409 | B1 | | 11/2003 |
| EP | 0 826 089 | B1 | | 8/2004 |
| EP | 1 121 488 | B1 | | 12/2004 |
| EP | 1 190 139 | B1 | | 12/2004 |
| EP | 0 951 602 | B1 | | 5/2005 |
| JP | 55037328 | A | * | 3/1980 |
| WO | WO 99/16974 | A1 | | 4/1999 |
| WO | WO 00/15907 | A1 | | 3/2000 |
| WO | WO 03004388 | A2 | * | 1/2003 |
| WO | WO 03/027390 | A2 | | 4/2003 |
| WO | WO 2010035189 | A2 | * | 4/2010 |

OTHER PUBLICATIONS

TAPPI Official Test Method T 411 om-89, "Thickness (Caliper) of Paper, Paperboard, and Combined Board," published by the TAPPI Press, Atlanta, Georgia, revised 1989, pp. 1-3.

* cited by examiner

SURFACE TREATING TISSUE WEBS VIA PATTERNED SPRAYING

BACKGROUND OF THE INVENTION

In the production of tissue products, such as facial tissue, bath tissue and paper towels, manufacturers continually strive to improve the properties of tissue products to deliver attributes desired by consumers, such as improved softness and strength. While softness is commonly improved by post-treating the dry tissue, strength properties are generally derived from chemicals added to the fibers at the wet end of the tissue making process. Because of the nature of high speed commercial manufacturing, the machine direction and cross-machine direction strength properties of tissue sheets are not equal. Instead, the machine direction strength properties are generally significantly higher than the corresponding cross-machine direction properties, which makes the cross-machine direction properties the limiting factor for user acceptance.

Therefore there is a need for a method of improving tissue sheet properties, particularly the cross-machine direction strength and durability properties.

SUMMARY OF THE INVENTION

It has now been discovered that papermaking chemicals can be sprayed onto the surface of a tissue sheet in a distinct pattern to selectively modify the properties of the tissue sheet. This method can be particularly advantageous for improving the dry and/or wet cross-machine direction (CD) properties of the sheet.

Hence in one aspect, the invention resides in a method of treating a tissue web, particularly a semi-dry tissue web, comprising: (a) passing the tissue web over a rotating hollow roll having a shell with a pattern of openings therein, the roll rotating at a speed about equal to the speed of the web; and (b) spraying a papermaking chemical from within the hollow roll and outwardly through the openings in the shell, whereby the papermaking chemical is deposited onto the tissue web in a pattern. Depending upon the relative speed difference between the web and the roll surface (the shell), if any, and the gap distance between the roll surface and the tissue web, if any, the resulting pattern of chemical deposits on the tissue web can correspond, or at least substantially correspond, to the pattern of openings in the shell of the roll. However, as the relative speed difference increases and/or the gap distance increases, the deposit pattern on the surface of the web can blurred. This may or may not be a desirable result, depending upon the desired distribution of chemical on the tissue web. In this regard, differences between the roll opening pattern and the pattern of deposits on the tissue web will tend to be more pronounced in the machine direction due to any relative speed differences that will tend to "elongate" and distort the deposits in the machine direction. Nevertheless, such situations still result in a pattern of deposits, as distinguished from a uniform coating or distribution.

In another aspect, the invention resides in a spraying apparatus comprising: (a) a hollow cylinder comprising a shell having an interior surface and an exterior surface, said hollow cylinder being rotatable about its axis and said shell having a pattern of openings therein; (b) a spray header positioned within the hollow cylinder, said spray header having a plurality of spaced-apart openings or nozzles directed at the interior surface of the shell; and (c) a pressurized source of a papermaking chemical in fluid communication with the spray header, such that the papermaking chemical can be sprayed outwardly from the spray header through the openings in the cylindrical shell.

A used herein, a "spray header" is source of multiple spray streams, which conveniently can be a single device with multiple spray orifices or nozzles, or it can be a collection of individual spray devices. The spray header is advantageously elongated and oriented generally parallel to the axis of the roll with the openings or nozzles directed toward the inner surface of the shell at the point where the outer shell surface will be contacting or within the vicinity of the tissue sheet.

As used herein, a "registered-spray roll" is a hollow roll having cylindrical outer shell, a pattern of openings in the shell, and a spray header within the roll positioned to spray liquids outwardly through the openings in the outer shell to deposit a desired pattern on a targeted surface. An advantage of using a registered-spray roll to deliver the patterned application of papermaking chemical to the web is that the consequences of overspray are minimized or eliminated because any chemical that does not reach the tissue sheet is confined within the interior of the roll. Advantageously, the excess chemical can be removed using sideways and/or downward-pointing nozzles spraying water that washes the chemical from the interior walls of the roll. The resulting water/chemical mixture can be drained from the roll via gravity, collected and recycled, if desired.

As used herein, a "papermaking chemical" is a chemical useful for modifying the physical properties of a paper sheet and which can be delivered in an aqueous or otherwise fluid state. Such papermaking chemicals include, without limitation, water, softeners (including debonders), strength agents and absorbency additives (such as surfactants). The papermaking chemical is preferably sprayed as an aqueous solution or suspension, although some papermaking chemicals can be applied at 100 percent solids or, alternatively, dissolved or suspended in a solvent other than water. In most cases, the papermaking chemical is applied as a dilute aqueous solution having a concentration of about 10 weight percent solids or less. Without being bound by theory, it should be noted that both the papermaking chemical and the solvent can affect the sheet properties, particularly when a dilute solution is utilized. In the most common case, where the papermaking chemical is delivered as an aqueous solution, the water being sprayed simultaneously with the other chemical will, at a minimum, change the solids content of the web, which in and of itself can alter the properties of the final product. For example, to the extent the web solids is decreased by the water in an aqueous-based spray, the web response to subsequent dewatering and/or molding vacuums will be altered. In the most extreme case, water alone can be sprayed to change the dry web properties, though it is unlikely the wet-web properties can be significantly improved with water alone. Other solution properties can also alter the effect of the sprayed solution on the web. For example, should a hot solution be used, the spray will alter the web temperature, potentially affecting downstream operations such as vacuum dewatering.

Suitable softeners include, but are not limited to, lotions, polysiloxanes, quaternary ammonium compounds, and polyester polyquaternary ammonium compounds; imidazolinium compounds; bis-imidazolinium compounds; diquaternary ammonium compounds; polyquaternary ammonium compounds; ester-functional quaternary ammonium compounds (e.g., quaternized fatty acid trialkanolamine ester salts); phospholipid derivatives; mono- and polysaccharide derivatives; polyhydroxy hydrocarbons; and the like.

Suitable debonders include, but are not limited to, cationic debonding agents such as quaternary ammonium salts, mono fatty alkyl tertiary amine salts, primary amine salts, imidazoline quaternary salts, unsaturated fatty alkyl amine salts, dialkyldimethylammonium salts such as ditallow dimethyl ammonium chloride, ditallow dimethylammonium methyl sulfate, and di(hydrogenated)tallow dimethyl ammonium chloride. Particularly suitable debonding agents are 1-methyl-2 noroleyl-3 oleyl amidoethyl imidazolinium methyl sulfate and 1-ethyl-2 noroleyl-3 oleyl amidoethyl imidazolinium ethylsulfate. Suitable commercial chemical debonding agents include, without limitation, Witco Varisoft® 6027 and Hercules Prosoft® TQ 1003.

When adding debonders in accordance with the method of this invention, the CD stretch of the tissue sheet can be increased from about 10 to about 30 percent on a relative basis. On an absolute basis, the CD stretch can be increased from about 1 to about 5 percent. In addition, the durability of the tissue is sheet, as measured by the ratio of the CD tensile energy absorbed (CD TEA) divided by the CD tensile strength, can also be increased from about 10 to about 30 percent.

Suitable strength agents include both wet strength agents and dry strength agents. As used herein, "wet strength agents" are materials used to immobilize the bonds between fibers in the wet state. Any material that when added to a paper web or sheet at an effective level results in providing the sheet with a wet geometric tensile strength:dry geometric tensile strength ratio in excess of 0.1 will, for purposes of this invention, be termed a wet strength agent. Typically these materials are termed either as permanent wet strength agents or as "temporary" wet strength agents. For the purposes of differentiating permanent from temporary wet strength, permanent will be defined as those resins which, when incorporated into paper or tissue products, will provide a product that retains more than 50% of its original wet tensile strength after exposure to water for a period of at least five minutes. Temporary wet strength agents are those which show less than 50% of their original wet strength after being saturated with water for five minutes. Suitable permanent wet strength agents are typically water soluble, cationic oligomeric or polymeric resins that are capable of either cross-linking with themselves or with the cellulose or other constituents of the wood fiber. The most widely-used materials for this purpose are the class of polymer known as polyamide-polyamine-epichlorohydrin type resins. These materials have been described in patents issued to Keim (U.S. Pat. No. 3,700,623 and U.S. Pat. No. 3,772,076) and are sold by Hercules, Inc., located in Wilmington, Del., as KYMENE 557H polyamine-epichlorohydrin resins. Related materials are marketed by Henkel Chemical Co., located in Charlotte, N.C., and Georgia-Pacific Resins, Inc., located in Atlanta, Ga.

Suitable temporary wet strength resins include, but are not limited to, those resins that have been developed by American Cyanamid and are marketed under the name PAREZ™ 631 NC wet strength resin (now available from Cytec Industries, located in West Paterson, N.J.). This and similar resins are described in U.S. Pat. No. 3,556,932 to Coscia, et al. and U.S. Pat. No. 3,556,933 to Williams, et al. Other temporary wet strength agents include modified starches such as those available from National Starch and marketed as CO BOND™ 1000 modified starch. Derivatized dialdehyde starches may also provide temporary wet strength.

Dry strength agents include, without limitation, starch, cationic starch, gums, anionic acrylamide copolymers, alum systems, various sizing agents such as alkenylsuccinic anhydride (ASA) or alkyl ketone dimmers (AKD) or rosin dispersion sizing agents such as Neutral Sizing Agent (NSA) from Georgia-Pacific Paper & Pulp Chemicals (Atlanta, Ga.), or retention aids such as HARMIDE resin from Harima Corp. (Osaka, Japan).

The amount of papermaking chemical added to the tissue web will depend on the open area of registered-spray roll, the concentration of the papermaking chemical in the solvent or carrier and the volumetric rate at which the papermaking chemical is sprayed. In general, the add-on amount of the papermaking chemical, expressed as a percent solids based on dry fiber, can be from about 0.004 to about 5 weight percent, more specifically from about 0.1 to about 5 weight percent and still more specifically from about 0.1 to about 1 weight percent.

As used herein, a "semi-dry" tissue web is a tissue web having a consistency (weight percent dry fiber) from about 15 to about 75 percent. While the invention can be applied to any web, including webs having a consistency from about 75 to 100 percent, it is advantageous to apply the papermaking chemicals to the web prior to final drying to avoid the need for additional drying capacity.

As used herein, passing the tissue web "over" a rotating registered-spray roll includes contacting the tissue web with the surface of the registered-spray roll, or leaving a gap or clearance so that there is no contact. Because the surface of the registered-spray roll acts as a "mask" for the spray header, the closer the tissue web is to the patterned surface of the registered-spray roll, the more distinct the spray pattern on the tissue web will be. As the tissue web is positioned further from the registered-spray roll, the resulting spray pattern on the tissue web will be less distinct and more "feathered" around the edges. Suitably the gap or clearance between the surface of the tissue web and the registered-spray roll outer shell surface can be from about 0.03 to about 2 inches, more specifically from about 0.05 to about 0.5 inch, and still more specifically from about 0.1 to about 0.3 inch.

The pattern of openings in the registered-spray roll surface can be any pattern that provides a desirable modification of the tissue sheet properties. This will depend upon the papermaking chemical being applied, its concentration, and the desired level of modification of the targeted physical property. For example, the openings in the roll surface can be "discrete" in the sense that the resulting spray pattern leaves "islands" of the tissue surface treated with the papermaking chemical that are surrounded by an untreated continuous network. This type of opening pattern is referred to as a "discrete" pattern, which is illustrated in FIGS. 2A and 2B, is particularly useful for applying papermaking chemicals intended to improve the softness of the tissue product by creating islands of softness surrounded by a stronger network of untreated fibers. Conversely, the openings in the roll surface can form a semi-continuous treated network on the tissue surface, such that "islands" of untreated tissue surface are essentially surrounded by a semi-continuous network of treated fibers. Referring to FIG. 2A, to create a semi-continuous opening pattern, the hexagons would be solid and the spaces between the hexagons would become the open area, subject to the need for some periodic structural support to bridge and connect the solid hexagonal areas. This is referred to as a "semi-continuous" pattern. In all cases, suitable opening shapes include, without limitation, circles, slits or polyhedrons, such as squares, rectangles, hexagons, octagons and the like. The shape and spacing of the openings can be uniform or non-uniform. In particular, it may be desirable to deposit relatively more papermaking chemical in the cross-machine direction of the sheet or, alternatively, in the machine direction of the sheet, in order to selectively modify one directional property more than the other.

In general, the size of the individual openings in the surface of the roll can be from about 0.01 to about 1 square inches, more specifically from about 0.02 to about 0.50 square inches, and still more specifically from about 0.05 to about 0.25 square inches. At the same time, the pattern density of the openings in the surface of the roll can be from about 0.5 to about 20 openings per square inch, more specifically from about 2 to about 10 openings per square inch, and still more specifically from about 4 to about 8 openings per square inch. The total open area of the surface of the roll, expressed as a percentage of the roll surface area, can be from about 20 to about 80 percent, more specifically from about 35 to 15 about 75 percent, and still more specifically from about 40 to about 65 percent.

In the interests of brevity and conciseness, any ranges of values set forth in this specification contemplate all values within the range and are to be construed as written description support for claims reciting any sub-ranges having endpoints which are whole number or otherwise of like numerical values within the specified range in question. By way of a hypothetical illustrative example, a disclosure in this specification of a range of from 1 to 5 shall be considered to support claims to any of the following ranges: 1-5; 1-4; 1-3; 1-2; 2-5; 2-4; 2-3; 3-5; 3-4; and 4-5. Similarly, a disclosure in this specification of a range from 0.1 to 0.5 shall be considered to support claims to any of the following ranges: 0.1-0.5; 0.1-0.4; 0.1-0.3; 0.1-0.2; 0.2-0.5; 0.2-0.4; 0.2-0.3; 0.3-0.5; 0.3-0.4; and 0.4-0.5. In addition, any values prefaced by the word "about" are to be construed as written description support for the value itself. By way of example, a range of "from about 1 to about 5" is to be interpreted as also disclosing and providing support for a range of "from 1 to 5", "from 1 to about 5" and "from about 1 to 5".

DETAILED DESCRIPTION OF THE DRAWINGS

Figure 1A:
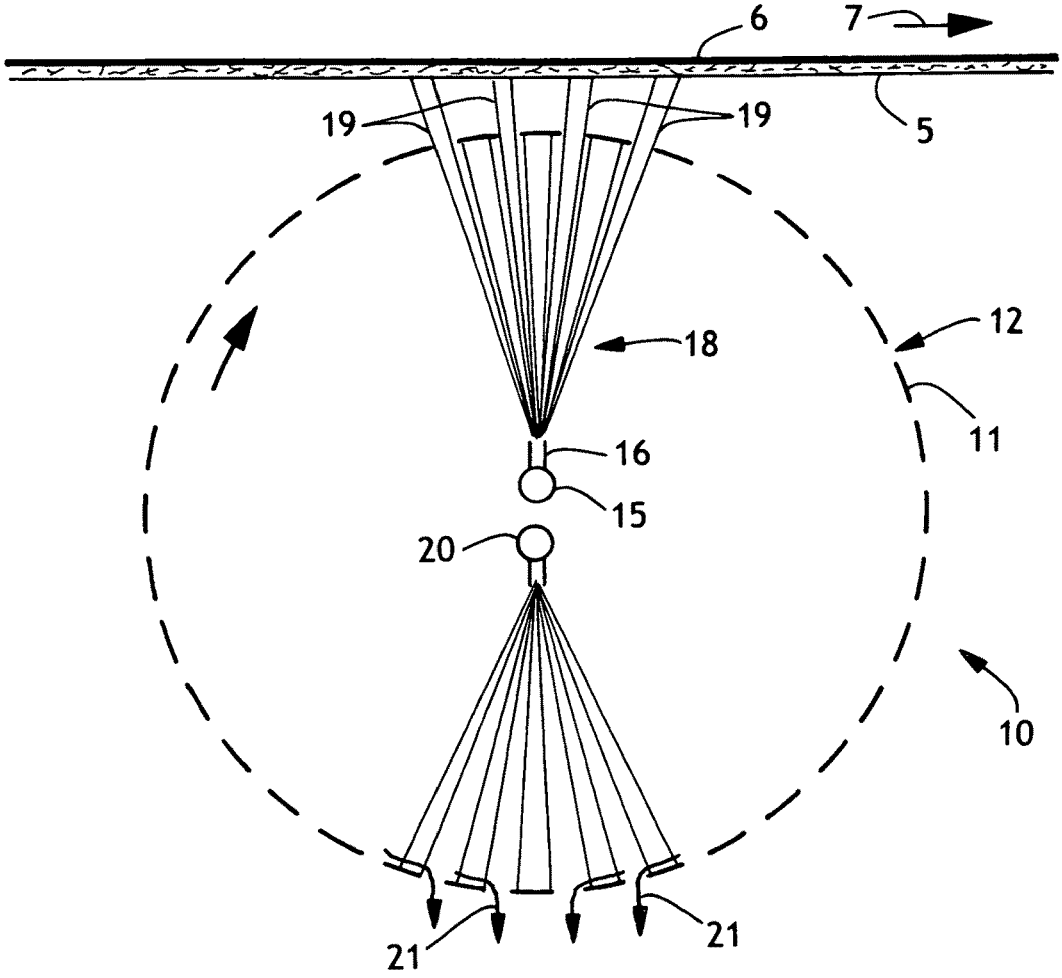
FIGS. 1A and 1B are schematic representations of the registered-spray roll, illustrating the application of the papermaking chemical in accordance with this invention.

Referring to FIG. 1A, the invention will be described in greater detail. In particular, FIG. 1A provides a schematic representation of the method of this invention as viewed in the cross-machine direction of the tissue making process. Shown is a tissue sheet 5 adhered to the underside of a papermaking fabric 6 travelling in the machine direction as indicated by the arrow 7. The registered-spray roll 10 comprises a rotating outer shell 11 having a patterned array of openings 12 through which the papermaking chemical is applied to the surface of the passing tissue web. Within the registered-spray roll is a spray header 15 having a plurality of axially spaced-apart nozzles 16 which spray the papermaking chemical outwardly through the openings in the shell onto the tissue web. The width of the spray pattern 18 can be varied as desired in order to obtain the desired add-on amount of papermaking chemical. As shown, some of the spray is blocked by the interior of the shell, while a portion of the spray 19 passes through the openings to result in a patterned application of the papermaking chemical on the surface of the tissue. Optionally, but desirably, a second spray header 20 is provided with a plurality of axially spaced-apart nozzles which are directed away from the tissue web, such as directly downwardly as shown, which spray the interior of the shell with water to remove build-up of papermaking chemical that does not pass through the shell openings. The water and washed chemical can be drained through the bottom of the shell, simply due to gravity as indicated by the arrows 21, so that the interior of the shell is clean by the time it rotates back into the vicinity of the tissue web.

Figure 1B:
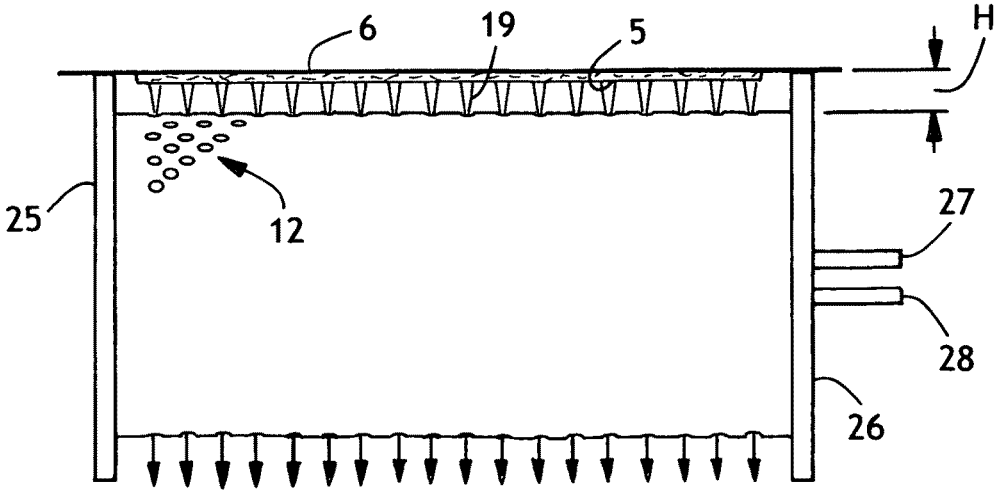

FIG. 1B is a schematic illustration of the registered-spray roll method of FIG. 1A as viewed in the machine direction of the tissue making process, illustrating one embodiment of the roll design that provides a means for creating a gap between the tissue web and the registered-spray roll outer surface. As shown, the registered-spray roll is provided with collars 25 and 26 at opposite ends of the roll. The spacing of the collars in the axial direction of the roll is wider than the width of the tissue sheet 5, but narrower than the width of the papermaking fabric 6. In this manner, the papermaking fabric can be urged against the collars of the roll to drive the roll without compressing the tissue sheet. The registered-spray roll can be independently driven by any suitable drive means, but using the papermaking fabric is a simple way to achieve the desired results.

The height "H" of the top of the collars, relative to the outer surface of the shell, can be from about 0.03 inch to about 2 inches as necessary to maintain the desired gap between the tissue sheet and the outer surface of the roll as previously described. Also shown are supply conduits 27 and 28, which feed the headers 15 and 20, respectively, shown in FIG. 1A.

Figure 2A:
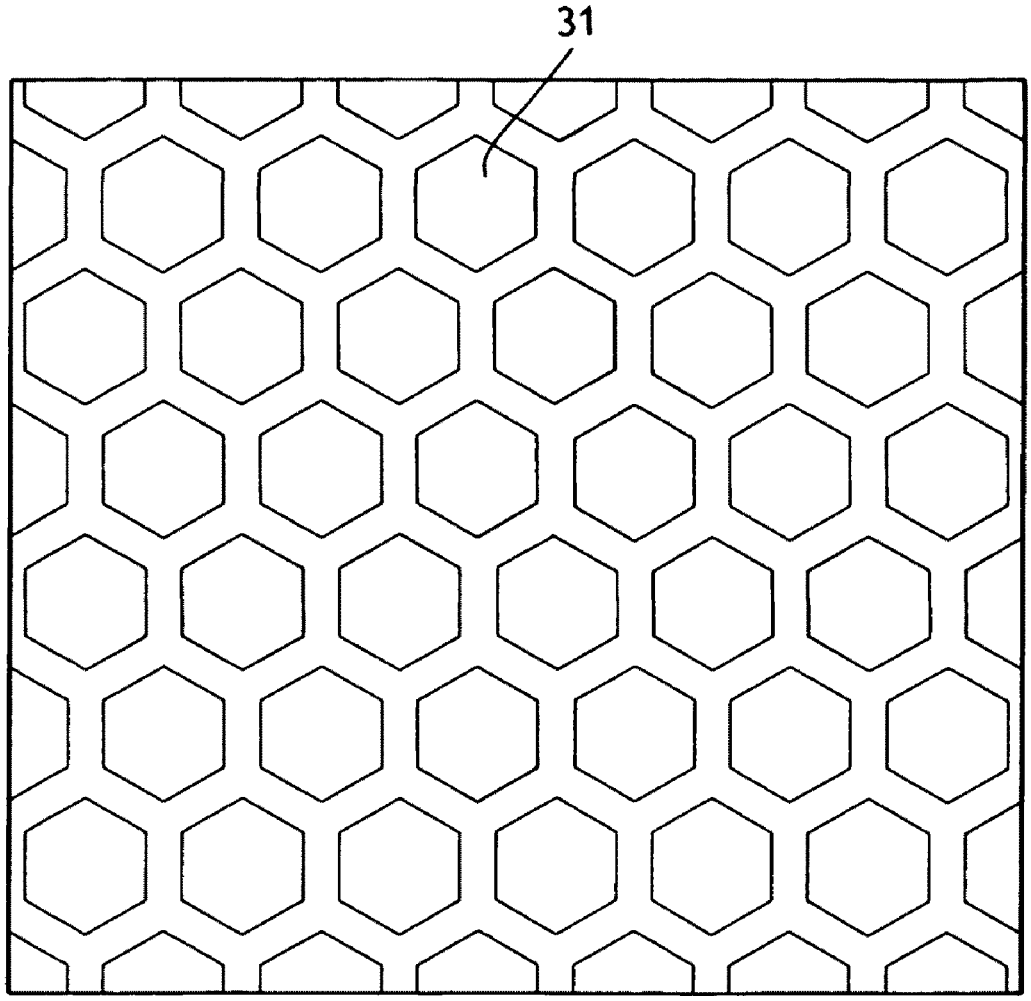
FIGS. 2A and 2B are plan views of two different embodiments of the registered-spray roll surface pattern suitable for purposes of this invention.

FIG. 2A is a plan view of the surface of a registered-spray roll, illustrating one embodiment of a suitable opening pattern. In this embodiment, the openings 31 are an array of hexagons. The dimensions of the hexagons are shown (in inches) in FIG. 2A, where the machine direction runs from left to right in this figure. The hexagons are 0.21 inch wide (in the cross-machine direction) and centered 0.24 inch apart in the machine direction. The wall thickness of the shell is about 0.036 inch. This pattern creates "islands" of treated areas on the surface of the tissue, which can be particularly suitable for the application softening or debonding chemicals since it leaves a continuous network of untreated tissue, which can be useful for strength retention if the applied chemical weakens the sheet in the areas where it is applied.

Figure 2B:
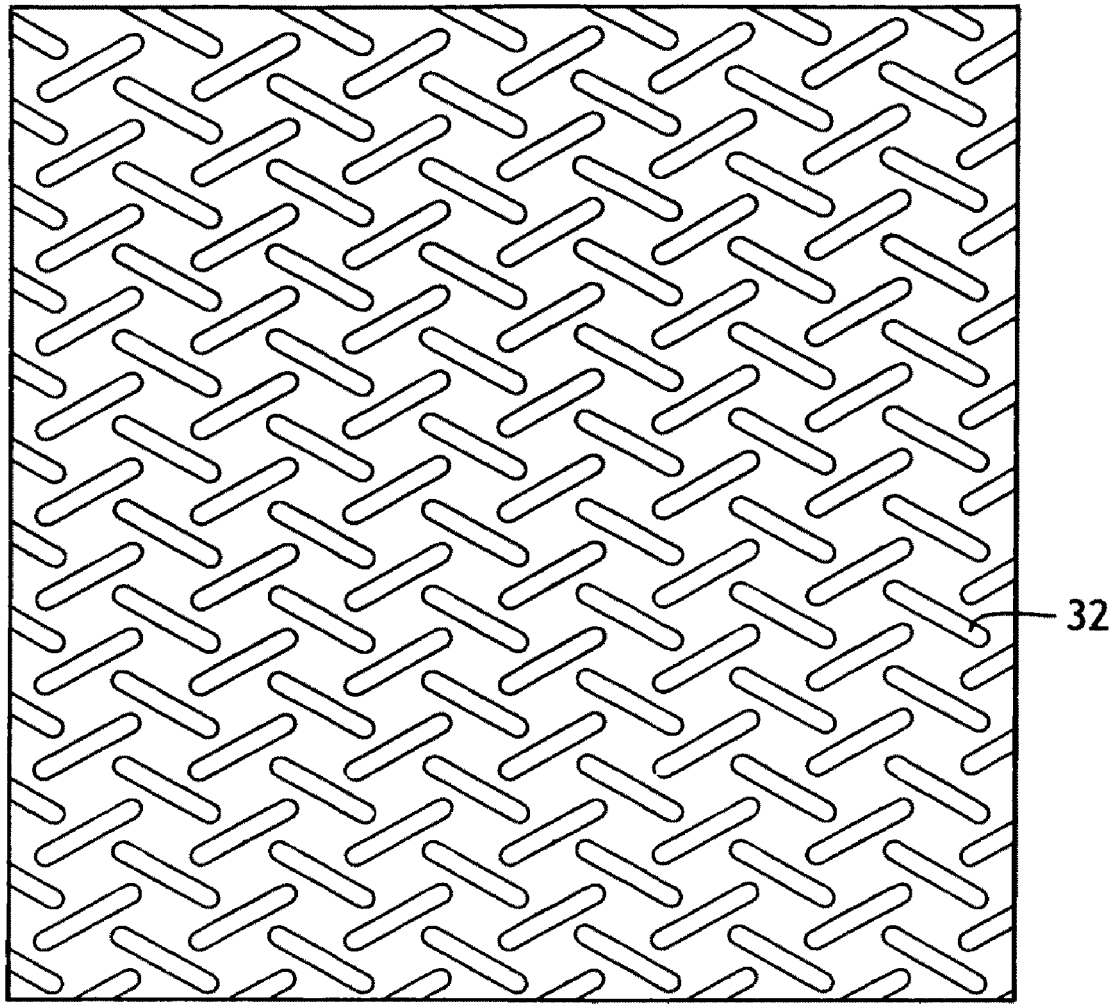

FIG. 2B is a plan view of the surface of a registered-spray roll, illustrating another embodiment of a suitable opening pattern. In this embodiment, the openings 32 are an array of slots and the machine direction runs from the top to the bottom of the figure. The orientation of the slots is biased toward the cross-machine direction, which can be advantageous when applying strength-enhancing chemicals in order to preferentially enhance the cross-machine direction strength properties of the resulting treated tissue sheet. In this embodiment, the dimensions of the slots are 0.3 inch long by 0.06 inch wide.

It will be appreciated that the shapes and dimensions of the openings in the shell are almost unlimited and will depend upon the specifics of the particular application.

Figure 3:
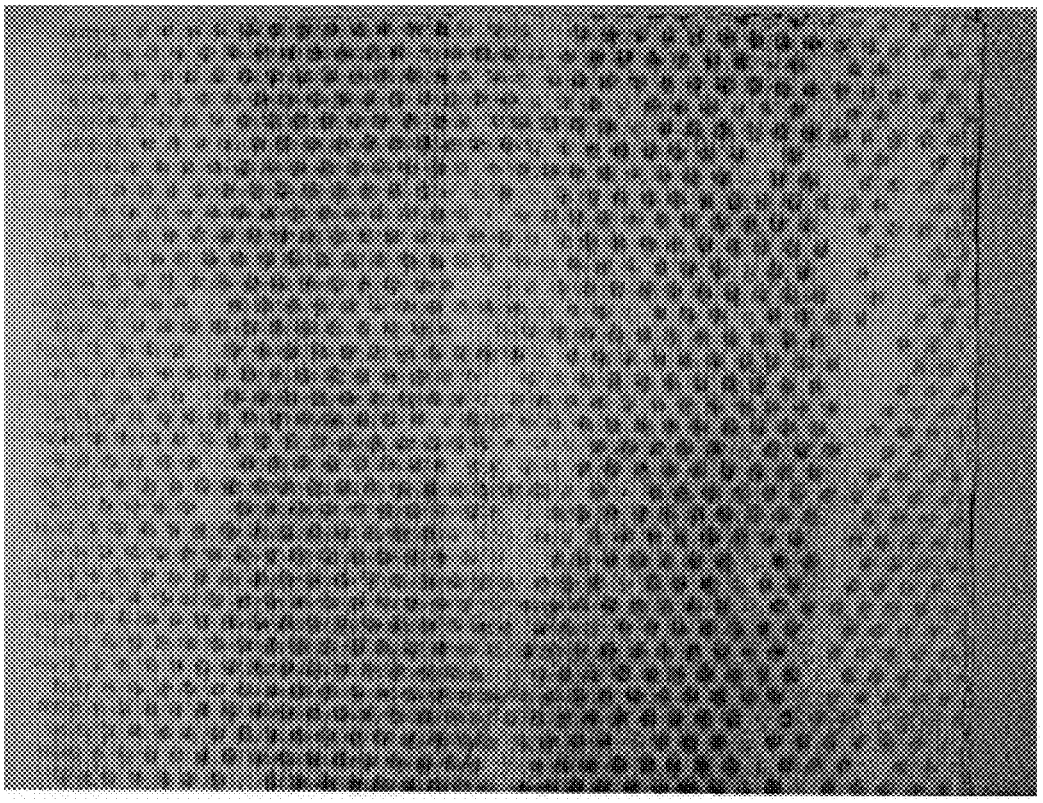
FIG. 3 is a photograph of a tissue sheet to which a papermaking chemical (with dye) was applied using the roll surface pattern of FIG. 2A in accordance with this invention, illustrating the resulting pattern of the applied papermaking chemical.

FIG. 3 is a photograph of a tissue sheet to which a dyed aqueous solution was applied using the registered-spray roll pattern of FIG. 2A with a gap of about 0.25 inch.

Test Methods

Sheet "bulk" is calculated as the quotient of the sheet "caliper" (hereinafter defined), expressed in microns, divided by the basis weight, expressed in grams per square meter. The resulting sheet bulk is expressed in cubic centimeters per gram. More specifically, the sheet caliper is the representative thickness of a single sheet measured in accordance with TAPPI test methods T402 "Standard Conditioning and Testing Atmosphere For Paper, Board, Pulp Handsheets and Related Products" and T411 om-89 "Thickness (caliper) of Paper, Paperboard, and Combined Board" with Note 3 for stacked sheets. The micrometer used for carrying out T411 om-89 is an Emveco 200-A Tissue Caliper Tester available from Emveco, Inc., Newberg, Oreg. The micrometer has a load of 2 kilo-Pascals, a pressure foot area of 2500 square millimeters, a pressure foot diameter of 56.42 millimeters, a dwell time of 3 seconds and a lowering rate of 0.8 millimeters per second.

As used herein, the "geometric mean tensile strength" is the square root of the product of the machine direction tensile strength multiplied by the cross-machine direction tensile strength. The "machine direction (MD) tensile strength" is the peak load per 3 inches (76.2 mm) of sample width when a sample is pulled to rupture in the machine direction. Similarly, the "cross-machine direction (CD) tensile strength" is the peak load per 3 inches (76.2 mm) of sample width when a sample is pulled to rupture in the cross-machine direction. The "stretch" is the percent elongation of the sample at the point of rupture during tensile testing. The procedure for measuring tensile strength is as follows.

Samples for tensile strength testing are prepared by cutting a 3 inches (76.2 mm) wide by 5 inches (127 mm) long strip in either the machine direction (MD) or cross-machine direction (CD) orientation using a JDC Precision Sample Cutter (Thwing-Albert Instrument Company, Philadelphia, Pa., Model No. JDC 3-10, Serial No. 37333). The instrument used for measuring tensile strengths is an MTS Systems Sintech 11S, Serial No. 6233. The data acquisition software is MTS TestWorks® for Windows Ver. 3.10 (MTS Systems Corp., Research Triangle Park, N.C.). The load cell is selected from either a 50 Newton or 100 Newton maximum, depending on the strength of the sample being tested, such that the majority of peak load values fall between 10-90% of the load cell's full scale value. The gauge length between jaws is 4±0.04 inches (101.6±1 mm). The jaws are operated using pneumatic-action and are rubber coated. The minimum grip face width is 3 inches (76.2 mm), and the approximate height of a jaw is 0.5 inches (12.7 mm). The crosshead speed is 10±0.4 inches/min (254±1 mm/min), and the break sensitivity is set at 65%. The sample is placed in the jaws of the instrument, centered both vertically and horizontally. The test is then started and ends when the specimen breaks. The peak load is recorded as either the "MD tensile strength" or the "CD tensile strength" of the specimen depending on direction of the sample being tested. At least six (6) representative specimens are tested for each product or sheet, taken "as is", and the arithmetic average of all individual specimen tests is either the MD or CD tensile strength for the product or sheet.

For measuring wet tensile strengths and related properties, testing is carried out as described above, except the test the specimen is pre-wetted using the following steps:

1. Place the specimen on a blotter paper i.e. 54.4 kg/ream (120 lb/ream), reliance grade, cut into 24.13 cm×30 cm. The blotter paper is made by Curtis Fine Paper with the part number 13-01-14 or equivalent. A new blotter paper is used with each new specimen.
2. Place a pad (such as "Scotch-Brite" brand, general purpose scrubbing pad, made by 3M™ with the part number 96 or equivalent) into a pan that contains distilled water. Remove the excess water from the pad by tapping it lightly three times on the wetting pan screen.
3. Place the wet pad directly parallel to the 3 inches width of the specimen in the approximate center. Hold in place for approximately one second.
4. Place the pad back into the wetting pan.
5. Immediately insert the test specimen into the jaws with the wet area being approximately centered horizontally and vertically between the upper and lower jaws and carry out the tensile testing as described above.

In addition to measuring the tensile strengths, the "tensile energy absorbed" (TEA) is also reported by the MTS TestWorks® for Windows Ver. 3.10 program for each sample tested. TEA is reported in the units of grams-centimeters/centimeters squared (g-cm/cm$^2$) and is defined as the integral of the force produced by a specimen with its elongation up to the defined break point (65% drop in peak load) divided by the face area of the specimen. The "geometric mean tensile energy absorbed" (GM TEA) is the square root of the product of the MD TEA and the CD TEA.

The "geometric mean slope" (GM Slope) is the square root of the product of the machine direction tensile slope and the cross-machine direction tensile slope. It is a measure of flexibility of the tissue. The tensile slope is the least squares regression slope of the load/elongation curve described above measured over the range of 70-157 grams (force). The slope is reported in kilograms per unit elongation (i.e. 100% strain) for a 76.2 mm wide sample.

"Pilling", sometimes referred to as "sloughing", is a tendency of a tissue sheet to shed fibers or clumps of fibers when rubbed or otherwise handled. The pilling test provides a quantitative measure of the abrasion resistance of a tissue sample. More specifically, the test measures the resistance of a material to an abrasive action when the material is subjected to a horizontally reciprocating surface abrader. The equipment and method used is similar to that described in U.S. Pat. No. 4,326,000, issued on Apr. 20, 1982 to Roberts, Jr. and assigned to the Scott Paper Company, the disclosure of which is herein incorporated by reference to the extent that it is non-contradictory herewith.

Figure 6:
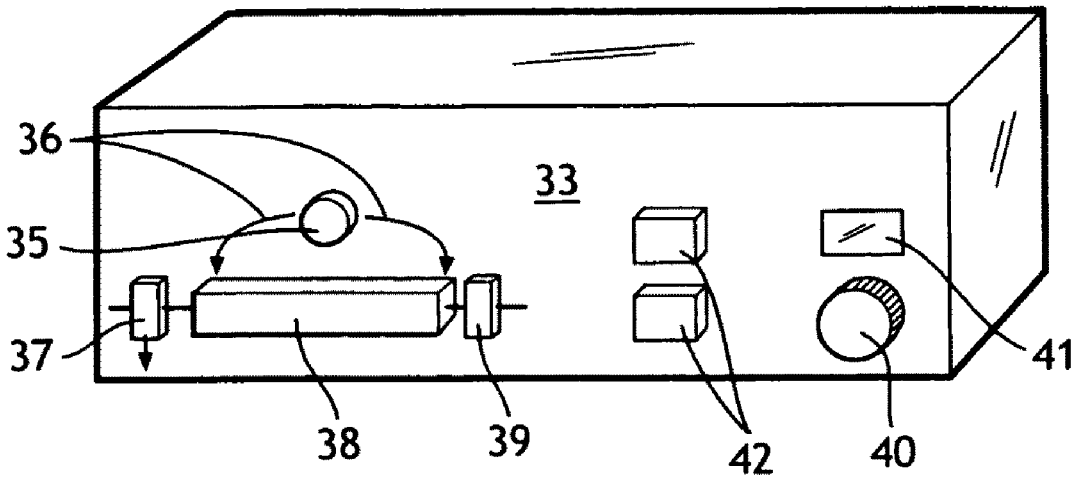
FIG. 6 is a schematic diagram of the test equipment for measuring pilling.

FIG. 6 is a schematic diagram of the test equipment used to measure pilling. Shown is the abrading spindle or mandrel 35, a double arrow 36 showing the motion of the mandrel 35, a sliding clamp 37, a slough tray 38, a stationary clamp 39, a cycle speed control 40, a counter 41, and start/stop controls 42. The abrading spindle 35 consists of a stainless steel rod, 0.5" in diameter with the abrasive portion consisting of a 0.005" deep diamond pattern knurl extending 4.25" in length around the entire circumference of the rod. The abrading spindle 35 is mounted perpendicularly to the face of the instrument 33 such that the abrasive portion of the abrading spindle 35 extends out its entire distance from the face of the instrument 33. On each side of the abrading spindle 35 is located a pair of clamps 37 and 39, one movable 37 and one fixed 39, spaced 4" apart and centered about the abrading spindle 35. The movable clamp 37 (weighing approximately 102.7 grams) is allowed to slide freely in the vertical direction, the weight of the movable clamp 37 providing the means for insuring a constant is tension of the tissue sheet sample over the surface of the abrading spindle 35.

Prior to testing, all tissue sheet samples are conditioned at 23° C.±1° C. and 50±2% relative humidity for a minimum of 4 hours. Using a JDC-3 or equivalent precision cutter, available from Thwing-Albert Instrument Company, located at Philadelphia, Pa., the tissue sheet sample specimens are cut into 3"±0.05" wide×7" long strips (note: length is not critical as long as specimen can span distance so as to be inserted into the clamps 37 and 39). For tissue sheet samples, the MD direction corresponds to the longer dimension. Each tissue sheet sample is weighed to the nearest 0.1 mg. One end of the tissue sheet sample is clamped to the fixed clamp 39, the sample then loosely draped over the abrading spindle or mandrel 35 and clamped into the sliding clamp 37. The entire width of the tissue sheet sample should be in contact with the abrading spindle 35. The sliding clamp 37 is then allowed to fall providing constant tension across the abrading spindle 35.

The abrading spindle 35 is then moved back and forth at an approximate 15 degree angle from the centered vertical centerline in a reciprocal horizontal motion against the tissue sheet sample for 20 cycles (each cycle is a back and forth stroke), at a speed of 170 cycles per minute, removing loose fibers from the surface of the tissue sheet sample. Additionally the spindle rotates counter clockwise (when looking at the front of the instrument) at an approximate speed of 5 RPMs. The tissue sheet sample is then removed from the jaws 37 and 39 and any loose fibers on the surface of the tissue sheet sample are removed by gently shaking the tissue sheet sample. The tissue sheet sample is then weighed to the nearest 0.1 mg and the weight loss calculated. Ten tissue sheet specimens per sample are tested and the average weight loss value in milligrams (mg) is recorded, which is the Pilling value for the side of the tissue sheet being tested.

EXAMPLES

Example 1

In order to further illustrate the invention, bath tissue basesheets were made as illustrated in FIG. 1. More specifically, the application of a debonder using the registered-spray roll method of this invention was evaluated on a pilot tissue machine using tissue making technology generally as described in U.S. Pat. No. 5,607,551 for the production of bathroom tissue. A three-layered tissue sheet (33% eucalyptus, 34% northern softwood, 33% eucalyptus) sheet was produced in a single-ply format. A t-807-1 transfer fabric (similar to the t-216-3 throughdrying (TAD) fabric disclosed in U.S. Pat. No. 5,672,248) was used for all experiments and two different TAD fabrics were used: a Jetson (t-1207-6) fabric as described in U.S. Pat. No. 7,141,142 B2 (referred to as TAD fabric "A") and a t-807-1, the same as the transfer fabric (referred to as TAD fabric "B").

For the inventive samples, Hercules Prosoft® TQ-1003 debonder (a quaternary-salt based cationic surfactant) was sprayed onto the web using a registered-spray roll having surface opening pattern as illustrated in FIG. 2A, resulting in the dot pattern as shown in FIG. 3. The sprayed debonder was applied on the wet end of the machine, after the rush transfer step, but before the web was dried on the throughdrier. The gap between the patterned surface of the registered-spray roll and the surface of the tissue was about 0.25 inch. The spray debonder was applied at a concentration of approximately 0.05-0.1 kg solids per 100 liters of the aqueous system, depending on the desired add-on level. The addition of the aqueous solution resulted in a decrease in web solids of several percent immediately downstream of the registered-spray roll. The combination of water and debonder improved the web properties.

The resulting products of this invention were compared to two controls. One control was a tissue sheet where no debonder was added to the sheet. The second control had debonder added to the eucalyptus layers via the standard wet-end addition. In all cases, the process was unchanged with the exception of the debonder addition method.

Figure 4:
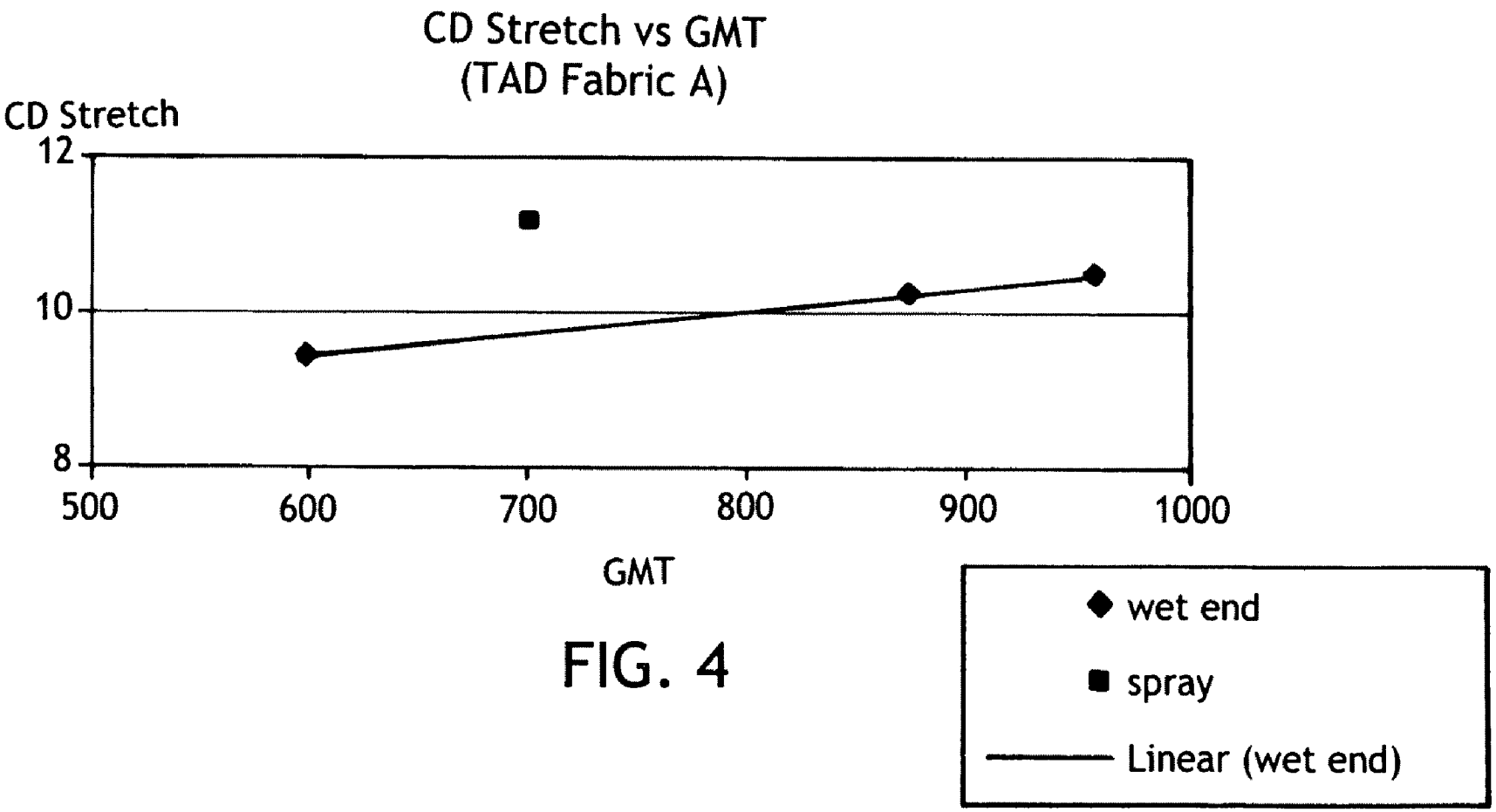
FIGS. 4 and 5 are plots of CD stretch versus GMT for the samples of Example 1, illustrating the improvement in CD stretch as a result of the method of this invention as compared to conventional wet end addition.
Figure 5:
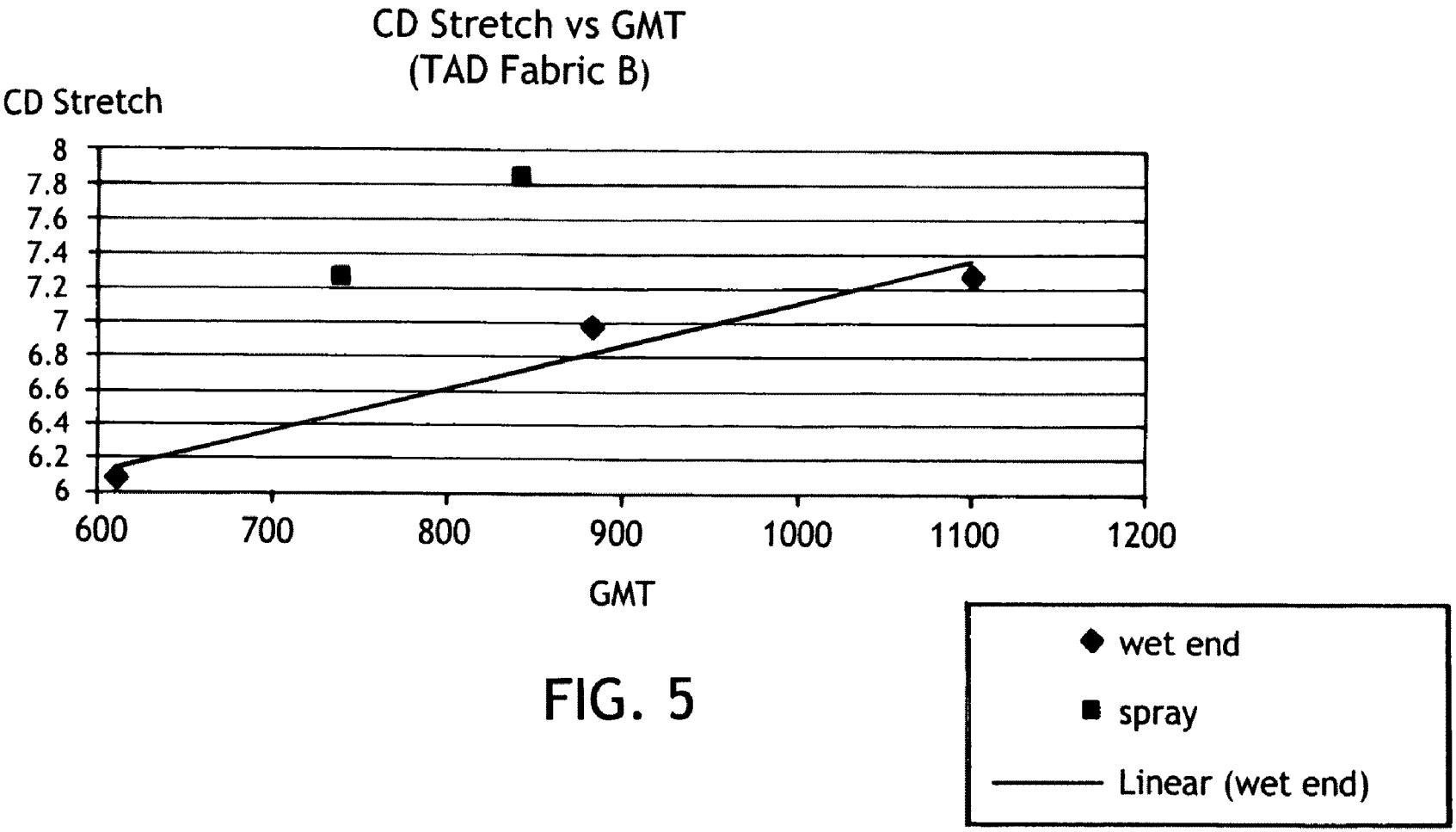

The inventive spray debonder codes showed an increase in CD stretch over both of the controls. This stretch increase was apparent for each of the two TAD fabrics evaluated (the t-807-1 and the Jetson). The results are shown in Table 1 below and FIGS. 4 and 5.

The reported results are the average dry property values obtained during the trial. Clearly the codes with spray debonder have higher CD stretch than do the non-spray debonder codes, particularly at the same tensile strength (either GMT or CD tensile). Samples are compared at constant tensile since CD stretch is affected by tensile strength. The CD stretch increase is consistent, and an increase in CD stretch is highly desired and is generally not easily obtained without causing other sheet properties to change in an undesirable manner. Higher CD stretch leads improved consumer attributes such as greater durability and/or reduced poke through.

TABLE 1

| Sample Code | TAD Fabric | Wet End Debonder kg/MT | Spray Debonder | MD Tensile | MD Stretch | CD Tensile | CD Stretch | GMT |
|---|---|---|---|---|---|---|---|---|
| Control 1 | A | 0 | 0 | 1396 | 16.7 | 659 | 10.5 | 959 |
| Control 2 | A | 2.5 | 0 | 1317 | 15.8 | 580 | 10.3 | 874 |
| Invention 1 | A | 2 | 2 | 1210 | 15.7 | 483 | 11.4 | 764 |
| Control 3 | A | 5 | 0 | 905 | 13.7 | 396 | 9.4 | 599 |
| Invention 2 | A | 0 | 3 | 1086 | 15.4 | 452 | 11.2 | 700 |
| Control 4 | B | 0 | 0 | 1566 | 16.6 | 773 | 7.3 | 1100 |
| Control 5 | B | 2.5 | 0 | 1271 | 16.7 | 613 | 7.0 | 883 |
| Invention 3 | B | 2 | 2 | 1194 | 16.0 | 517 | 6.9 | 786 |
| Control 6 | B | 5 | 0 | 892 | 14.6 | 417 | 6.1 | 610 |
| Invention 4 | B | 0 | 2 | 1197 | 15.8 | 591 | 7.9 | 841 |
| Invention 5 | B | 0 | 4 | 1151 | 16.1 | 474 | 7.3 | 739 |

Table 1 and the data plots of FIGS. 4A and 4B clearly show the increase in CD stretch associated with the use of the registered-spray application of the debonder. (FIG. 4A shows data for TAD fabric A and FIG. 4B shows the data for TAD fabric B.) The data clearly show that this increase in CD stretch is not due to a change in tensile strength. (Note the inventive sample codes 1 and 3 combining the registered-spray application of debonder with wet-end debonder are not shown on the above graphs to isolate the effect of spray versus wet-end debonder addition.)

At all tensile strengths, the CD stretch of the spray codes is higher than that of the controls. The increase is approximately a 1-2% increase in absolute CD stretch. This represents a considerable increase given that the CD stretch, without the registered-spray application of debonder, is about 10% or less.

In addition to the product effect of a CD stretch increase, there were process effects associated with the use of registered-spray roll debonder addition. For example, the tensile reduction for a given amount of debonder was higher for registered-spray roll addition than for wet-end addition (compare inventive sample 4 and control 5). There are several potential reasons for this, including the fact that some debonder penetrates into the center softwood layer and also possibly due to greater retention of the debonder when applied via registered-spray roll addition.

It should be noted that the registered-spray roll technique provides a way to turn the debonder addition "on" and "off" instantaneously should that capability be desired, such as on a machine where more than one grade of tissue is made from the same furnish. Alternately, by changing the registered-spray roll sleeve, the debonder pattern can be altered and hence optimized for different products without having to shut down the tissue machine.

Example 2

As a second example, another debonder trial was run on the same pilot tissue machine using a "slotted" registered-spray roll. The surface of this roll is shown schematically in FIG. 2B. Other than the change in the roll characteristics, the trial was similar to the previous trial of Example 1.

Several control codes were produced during this trial and they are identified as controls 1-3. The three controls were produced at the beginning of the trial, near the middle of the trial, and near the end of the trial, respectively. This was done to ensure that machine conditions, except those purposely varied, were essentially constant.

As Table 2 illustrates, the properties of the control codes were constant throughout the trial, with the geometric mean tensile strength (GMT) varying very little from the mean value of approximately 630 grams per 3-inches wide sample. The control codes show the sheet properties without either wet-end addition or registered-spray roll addition of chemical.

TABLE 2

| Sample: | Control 1 | Control 2 | Control 3 | Ave |
|---|---|---|---|---|
| Refining time (minutes) | none | none | none | none |
| Bulk Properties | | | | |
| Basis Weight - as is (lbs/2880 sq ft) | 18.19 | 18.43 | 18.77 | 18.46 |
| Caliper (inches) | 0.0276 | 0.0276 | 0.0281 | 0.0278 |
| Durability | | | | |
| Pilling (mg) | 6.95 | 5.35 | 4.1 | 5.5 |
| Dry Properties | | | | |
| GMT | 609 | 635 | 657 | 634 |
| CD Tensile (grams/3") | 414 | 458 | 488 | 453 |
| CD Stretch (%) | 13.47 | 13.66 | 12.904 | 13.34 |
| CD TEA (gm cm/cm^2) | 4.24 | 4.95 | 4.93 | 4.71 |
| (CD TEA/ CD Tensile) * 100 | 1.02 | 1.08 | 1.01 | 1.04 |
| CD Slope (kg) | 2.37 | 2.64 | 3.09 | 2.70 |
| MD Tensile (grams/3") | 895 | 882 | 885 | 887 |
| MD Stretch (%) | 19.45 | 20.388 | 20.29 | 20.04 |
| MD TEA at Fail (gm cm/cm^2) | 12.65 | 12.84 | 12.98 | 12.82 |
| MD Slope (kg) | 5.07 | 4.65 | 4.904 | 4.88 |
| Wet Properties | | | | |
| CD Tensile (grams/3") | 51.26 | 56.93 | 54.89 | 54.36 |
| CD Wet Tensile/ Dry Tensile | 12 | 12 | 11 | 12 |
| CD Stretch (%) | 16.20 | 17.76 | 17.65 | 17.20 |
| CD TEA (gm cm/cm^2) | 0.93 | 1.15 | 1.15 | 1.08 |
| (CD TEA/ CD Tensile) * 1000 | 2.26 | 2.51 | 2.35 | 2.38 |
| CD Slope (kg) | 0.35 | 0.35 | 0.316 | 0.34 |

After the first control sample was produced, samples with wet-end debonder addition (codes deb 1-4) and registered-spray roll debonder addition (codes deb 5-8) were produced. For the wet-end samples, the debonder was added to the outer eucalyptus layers. Sample codes with addition levels of 2.5 and 5 kg/metric ton (MT) (based on the total sheet weight) were produced with wet-end addition, then similar codes were produced using registered-spray roll addition of the chemical. For all codes with debonder, the pulp was refined for 3 minutes so that the final tensile strength would be comparable to those of the control codes previously described.

The data for the debonder codes is shown in Table 3 below. Table 3 shows the data for each experimental run, plus an average (Ave) for both the wet-end addition (WE) and registered-spray roll addition (spray) codes. Despite the difference in application method, the two methods produced sheets with roughly the same GMT (627 g/3 inches for the wet-end addition and 641 g/3 inches for the registered-spray roll addition). Given the similar geometric mean tensile strengths, the other properties of the webs can be compared without tensile strength affecting the results.

TABLE 3

(Debonder Experiments)

| | Sample: | | | | | | | | | |
|---|---|---|---|---|---|---|---|---|---|---|
| | 1 | 2 | 3 | 4 | | 5 | 6 | 7 | 8 | |
| Chemical Addition Location | wet end | wet end | wet end | wet end | Ave | spray | spray | spray | spray | Ave |
| Refining time (minutes) | 3 | 3 | 3 | 3 | 3 | 3 | 3 | 3 | 3 | 3 |

TABLE 3-continued (Debonder Experiments)

| | Sample: | | | | | | | | | |
|---|---|---|---|---|---|---|---|---|---|---|
| | 1 | 2 | 3 | 4 | | 5 | 6 | 7 | 8 | |
| Addition level (kg/MT) | 2.5 | 2.5 | 5 | 5 | | 2.5 | 2.5 | 5 | 5 | |
| Bulk Properties | | | | | | | | | | |
| Basis Weight - as is (lbs/2880 sq ft) | 18.73 | 18.29 | 19.37 | 18.73 | 18.78 | 18.20 | 18.15 | 17.54 | 17.94 | 17.96 |
| Caliper (inches) | 0.029 | 0.029 | 0.028 | 0.029 | 0.029 | 0.031 | 0.030 | 0.030 | 0.030 | 0.030 |
| Durability | | | | | | | | | | |
| Pilling (mg) | 7.4 | 5.85 | 7.85 | 8.05 | 7.29 | 3.55 | 3.75 | 4.65 | 5.3 | 4.31 |
| Dry Properties | | | | | | | | | | |
| GMT | 648 | 674 | 611 | 574 | 627 | 769 | 732 | 498 | 563 | 641 |
| CD Tensile (grams/3") | 430 | 498 | 407 | 421 | 439 | 548 | 566 | 319 | 386 | 455 |
| CD Stretch (%) | 13.3 | 14.5 | 13.3 | 13.5 | 13.6 | 15.2 | 16.0 | 15.0 | 14.7 | 15.3 |
| CD TEA (gm cm/cm^2) | 4.77 | 5.42 | 4.14 | 4.24 | 4.64 | 5.92 | 6.27 | 3.51 | 4.01 | 4.93 |
| (CD TEA/CD Tensile) * 100 | 1.11 | 1.09 | 1.02 | 1.01 | 1.05 | 1.08 | 1.11 | 1.10 | 1.04 | 1.08 |
| CD Slope (kg) | 2.48 | 2.43 | 2.32 | 2.338 | 2.391 | 2.52 | 2.4 | 1.68 | 1.95 | 2.14 |
| MD Tensile (grams/3") | 977 | 912 | 918 | 782 | 897 | 1080 | 946 | 778 | 820 | 906 |
| MD Stretch (%) | 20.51 | 19.09 | 19.68 | 18.95 | 19.56 | 19.60 | 18.30 | 17.95 | 17.96 | 18.45 |
| MD TEA at Fail (gm cm/cm^2) | 14.99 | 13.66 | 13.50 | 11.33 | 13.37 | 16.38 | 13.69 | 11.44 | 11.95 | 13.37 |
| MD Slope (kg) | 5.71 | 5.85 | 5.33 | 4.81 | 5.425 | 6.45 | 6.422 | 5.814 | 6.092 | 6.19 |
| Wet Properties | | | | | | | | | | |
| CD Tensile (grams/3") | 37 | 38 | 38 | 38 | 38 | 40 | 42 | 39 | 38 | 40 |
| CD Wet Tensile/Dry Tensile | 9 | 8 | 9 | 9 | 8.60 | 7 | 7 | 12 | 10 | 9.17 |
| CD Stretch (%) | 9.7 | 10.0 | 9.2 | 9.5 | 9.6 | 13.0 | 13.7 | 10.1 | 10.0 | 11.7 |
| CD TEA (gm cm/cm^2) | 0.48 | 0.49 | 0.45 | 0.44 | 0.47 | 0.63 | 0.67 | 0.49 | 0.45 | 0.56 |
| (CD TEA/CD Tensile) * 1000 | 1.11 | 0.98 | 1.11 | 1.06 | 1.06 | 1.15 | 1.19 | 1.54 | 1.16 | 1.26 |

Comparing the average wet-end addition result to the average registered-spray roll addition result, a number of differences are apparent. The registered-spray roll addition codes have an advantage in a number of key cross-machine direction properties, including wet and dry CD stretch, wet and dry CD TEA and most importantly, the ratio of the wet and dry CD TEA divided by dry tensile strength. For example, the wet CD stretch of the registered-spray roll addition codes averaged 11.7% versus 9.6% for the wet-end addition codes. This relative difference of greater than 20% is significant. Similarly, the wet CD TEA/CD tensile ratio (multiplied by 1000 in Table 3) of the registered-spray roll addition code is 1.26 versus 1.06 for the wet-end addition code.

As in the example with the registered-spray roll surface opening pattern of FIG. 2A, this data shows the advantages brought by registered-spray roll addition in terms of improved CD sheet properties. Since the sheet is generally weaker in the CD than in the MD, the improvement in CD properties, particularly in the wet state where the web tends to fail more easily, makes for a more durable, and hence preferred, tissue product.

Example 3

After the debonder-containing samples were produced as described above in Example 2, a similar procedure was carried out to produce samples containing Hercobond® temporary wet strength agent. For these samples, no refining was used and, for the wet-end codes, the Hercobond® temporary wet strength agent was added to the center (softwood) layer. Control sample codes with 2 kg/MT and 4 kg/MT of the temporary wet strength agent were produced. Thereafter, similar codes with similar temporary wet strength agent add-on levels were produced using the slotted registered-spray roll addition of this invention.

The chemical spray concentration ranged from roughly 0.04-0.08 kg solids per 100 liters of aqueous solution. The combination of water and Hercobond® temporary wet strength agent improved the web properties. Again, essentially equal GMT codes were produced with both techniques facilitating a comparison of the properties of the products produced via the two methods.

The results are shown in Table 4 below. As with the previous debonder codes of Example 2, the results demonstrate that the registered-spray roll addition of a temporary wet strength agent yielded superior CD sheet properties as compared to the wet-end addition. For example, CD wet stretch for the registered-spray roll addition codes was an average of 18.6% versus 16.3% for the wet-end addition codes. A similar improvement in wet CD TEA and the ratio of wet CD TEA/CD tensile was also apparent. These results confirm the results obtained in the previous debonder experiments.

TABLE 4

(Hercobond ® Temporary Wet Strength Agent Experiments)

| | Sample: | | | | | | | | | |
|---|---|---|---|---|---|---|---|---|---|---|
| | 1 | 2 | 3 | 4 | | 5 | 6 | Her 7 | Her 8 | |
| Chemical Addition Location | wet end | wet end | wet end | wet end | Ave | spray | spray | spray | spray | Spray Ave |
| Refining time (minutes) | 0 | 0 | 0 | 0 | 0 | 0 | 0 | 0 | 0 | 0 |
| Chemical Addition (kg/MT) | 2 | 2 | 4 | 4 | Ave | 2 | 2 | 4 spray | 4 spray | Spray Ave |
| Bulk Properties | | | | | | | | | | |
| Basis Weight - as is (lbs/2880 sq ft) | 19.22 | 18.74 | 18.49 | 18.28 | 18.68 | 18.76 | 18.55 | 18.44 | 18.49 | 18.56 |
| Caliper (inches) | 0.028 | 0.028 | 0.029 | 0.029 | 0.029 | 0.030 | 0.030 | 0.030 | 0.030 | 0.030 |
| Durability | | | | | | | | | | |
| Pilling (mg) | 4.75 | 4.55 | 4.9 | 5.6 | 4.95 | 4 | 3.75 | 3.45 | 4.05 | 3.81 |
| Dry Properties | | | | | | | | | | |
| GMT | 722 | 710 | 734 | 697 | 716 | 667 | 700 | 771 | 770 | 727 |
| CD Tensile (grams/3") | 530 | 483 | 526 | 497 | 509 | 487 | 534 | 583 | 568 | 543 |
| CD Stretch (%) | 14.5 | 14.6 | 15.0 | 14.9 | 14.7 | 16.3 | 16.8 | 16.6 | 17.1 | 16.7 |
| CD TEA (gm cm/cm^2) | 5.68 | 5.622 | 5.8976 | 5.6222 | 5.71 | 5.7642 | 6.5904 | 7.0554 | 6.9054 | 6.58 |
| CT TEA/CD T * 100 | 1.07 | 1.16 | 1.12 | 1.13 | 1.12 | 1.18 | 1.23 | 1.21 | 1.22 | 1.21 |
| CD Slope (kg) | 2.73 | 2.532 | 2.54 | 2.494 | 2.57 | 2.208 | 2.456 | 2.56 | 2.398 | 2.41 |
| MD Tensile (grams/3") | 982 | 1044 | 1024 | 975 | 1007 | 913 | 918 | 1020 | 1043 | 974 |
| MD Stretch (%) | 20.1 | 21.3 | 19.9 | 21.0 | 20.6 | 19.6 | 19.2 | 20.7 | 20.0 | 19.9 |
| MD TEA at Fail (gm cm/cm^2) | 14.94 | 16.05 | 15.03 | 14.36 | 15.10 | 13.83 | 13.60 | 16.16 | 16.21 | 14.95 |
| MD Slope (kg) | 5.55 | 5.97 | 5.65 | 4.82 | 5.50 | 5.39 | 5.93 | 6.21 | 6.35 | 5.97 |
| Wet Properties | | | | | | | | | | |
| CD Tensile (grams/3") | 98 | 82 | 111 | 111 | 100 | 101 | 95 | 127 | 130 | 113 |
| CD Wet Tensile/DryTensile | 19 | 17 | 21 | 22 | 19.72 | 21 | 18 | 22 | 23 | 20.83 |
| CD Stretch (%) | 15.2 | 16.4 | 16.6 | 16.9 | 16.3 | 18.1 | 18.2 | 19.5 | 18.6 | 18.6 |
| CD TEA (gm cm/cm^2) | 1.46 | 1.32 | 1.70 | 1.71 | 1.55 | 1.60 | 1.49 | 2.06 | 2.02 | 1.79 |
| CD TEA/CD Tensile * 1000 | 2.75 | 2.73 | 3.24 | 3.43 | 3.04 | 3.29 | 2.79 | 3.54 | 3.55 | 3.29 |
| CD Slope (kg) | 0.686 | 0.572 | | | | 0.588 | 0.566 | 0.632 | 0.648 | |

Example 4

Another set of experiments was carried out, this time using Kymene® wet strength agent as is typically used in paper towels. As with the Hercobond® codes, the Kymene® wet strength agent was added to the center layer for the wet-end addition codes. One sample with 5 kg/MT was produced and two samples with 10 kg/MT were produced. To facilitate an accurate comparison, similar samples were produced via the registered-spray roll technique of this invention. For the spray codes, the chemical spray concentration ranged from roughly 0.1 to 0.2 kg solids per 100 liters of aqueous solution. The combination of water and Kymene® wet strength agent improved the web properties. The Kymene® wet strength agent codes are shown in Table 5 below.

TABLE 5

(Kymene ® Wet Strength Agent Experiments)

| Sample: | | | | | | | |
|---|---|---|---|---|---|---|---|
| Chemical Addition Location | wet end | wet end | wet end | Ave | spray | spray | spray |
| Refining time (minutes) | 0 | 0 | 0 | 0 | 0 | 0 | 0 |
| Chemical Addition (kg/MT) | 5 | 10 | 10 | | 5 | 10 | 10 |
| Bulk Properties | | | | | | | |
| Basis Weight - as is (lbs/2880 sq ft) | 18.6 | 18.5 | 18.5 | 18.6 | 18.7 | 18.8 | 18.7 |
| Caliper (inches) | 0.029 | 0.030 | 0.029 | 0.029 | 0.030 | 0.031 | 0.030 |
| Durability | | | | | | | |
| Pilling (mg) | 6.05 | 4 | 3.65 | 4.57 | 4.75 | 3.1 | 3.25 |

TABLE 5-continued (Kymene ® Wet Strength Agent Experiments)

| Sample: | | | | | | | |
|---|---|---|---|---|---|---|---|
| Dry Properties | | | | | | | |
| GMT | 792 | 828 | 854 | 825 | 670 | 767 | 757 |
| CD Tensile (grams/3") | 560 | 591 | 644 | 599 | 512 | 577 | 598 |
| CD Stretch (%) | 14.8 | 15.6 | 16.3 | 15.6 | 16.8 | 17.2 | 17.8 |
| CD TEA (gm cm/cm^2) | 6.62 | 7.13 | 7.71 | 7.15 | 6.51 | 7.65 | 7.73 |
| (CD TEA/CD Tensile) * 100 | 1.18 | 1.21 | 1.20 | 1.19 | 1.27 | 1.32 | 1.29 |
| CD Slope (kg) | 2.77 | 2.69 | 2.74 | 2.73 | 2.23 | 2.40 | 2.27 |
| MD Tensile (grams/3") | 1119 | 1161 | 1133 | 1138 | 876 | 1018 | 958 |
| MD Stretch (%) | 21.1 | 21.3 | 20.5 | 20.9 | 19.7 | 20.6 | 19.5 |
| MD TEA at Fail (gm cm/cm^2) | 17.45 | 17.77 | 16.80 | 17.34 | 13.39 | 16.19 | 14.56 |
| MD Slope (kg) | 5.55 | 5.54 | 5.51 | 5.53 | 5.22 | 5.75 | 5.58 |
| Wet Properties | | | | | | | |
| CD Tensile (grams/3") | 157 | 185 | 191 | 178 | 124 | 170 | 158 |
| CD Wet Tensile/Dry Tensile | 28 | 31 | 30 | 29.6 | 24 | 29 | 26 |
| CD Stretch (%) | 17.6 | 18.9 | 18.7 | 18.4 | 18.6 | 19.8 | 20.0 |
| CD TEA (gm cm/cm^2) | 2.22 | 2.79 | 2.78 | 2.59 | 1.90 | 2.43 | 2.45 |
| (CD TEA/CD Tensile) * 1000 | 3.96 | 4.72 | 4.32 | 4.33 | 3.71 | 4.20 | 4.09 |
| CD Slope (kg) | | 0.73 | 0.742 | 0.74 | 0.63 | 0.67 | 0.67 |

The Kymene® wet strength agent spray codes yielded slightly lower tensile strength than the wet-end addition codes (a GMT of 731 grams/3 inches versus 825 grams/3 inches for the wet-end addition). Hence comparison of many of the properties is slightly affected by the tensile difference. However, one can compare properties such as the wet CD TEA/CD tensile ratio and, again, the spray codes of this invention exhibit better properties.

Because the foregoing Kymene® wet strength agent spray codes had a slightly lower strength than the wet-end codes, two additional samples were produced, this time with a spray addition of 13 kg/MT. Table 6 below shows the data for these codes and compares the wet-end codes to the total Kymene® wet strength agent spray data, with all codes included. Now the tensile strengths (GMT) are closer to equal, although the spray codes are still slightly weaker.

TABLE 6

(Additional Kymene ® Wet Strength Agent Experiments)

| | Sample: | | | | | | |
|---|---|---|---|---|---|---|---|
| | 7 | 8 | 9 | | 10 | 11 | |
| Chemical Addition Location | wet end | wet end | wet end | Ave | spray | spray | Ave |
| Refining time (minutes) | 0 | 0 | 0 | 0 | 0 | 0 | 0 |
| Chemical Addition (kg/MT) | 5 | 10 | 10 | | 13 | 13 | |
| Bulk Properties | | | | | | | |
| Basis Weight - as is (lbs/2880 sq ft) | 18.6 | 18.5 | 18.5 | 18.6 | 18.7 | 18.1 | 18.4 |
| Caliper (inches) | 0.029 | 0.030 | 0.029 | 0.029 | 0.030 | 0.031 | 0.030 |
| Durability | | | | | | | |
| Pilling (mg) | 6.05 | 4 | 3.65 | 4.57 | 3.35 | 3.05 | 3.20 |
| Dry Properties | | | | | | | |
| GMT | 792 | 828 | 854 | 825 | 769 | 761 | 765 |
| CD Tensile (grams/3") | 560 | 591 | 644 | 599 | 610 | 575 | 593 |
| CD Stretch (%) | 14.8 | 15.6 | 16.3 | 15.6 | 17.9 | 16.9 | 17.4 |
| CD TEA (gm cm/cm^2) | 6.62 | 7.13 | 7.71 | 7.15 | 7.85 | 7.48 | 7.67 |
| (CD TEA/CD Tensile) * 100 | 1.18 | 1.21 | 1.20 | 1.19 | 1.29 | 1.30 | 1.29 |
| CD Slope (kg) | 2.77 | 2.69 | 2.74 | 2.73 | 2.39 | 2.35 | 2.37 |
| MD Tensile (grams/3") | 1119 | 1161 | 1133 | 1138 | 970 | 1007 | 988 |
| MD Stretch (%) | 21.1 | 21.3 | 20.5 | 20.9 | 19.8 | 20.2 | 20.0 |
| MD TEA at Fail (gm cm/cm^2) | 17.45 | 17.77 | 16.80 | 17.34 | 15.46 | 15.97 | 15.71 |
| MD Slope (kg) | 5.55 | 5.54 | 5.51 | 5.53 | 5.53 | 6.03 | 5.78 |
| Wet Properties | | | | | | | |
| CD Tensile (grams/3") | 157 | 185 | 191 | 178 | 186 | 185 | 185 |
| CD Wet Tensile/Dry Tensile | 28 | 31 | 30 | 29.6 | 30 | 32 | 31 |
| CD Stretch (%) | 17.6 | 18.9 | 18.7 | 18.4 | 20.9 | 21.1 | 21.0 |
| CD TEA (gm cm/cm^2) | 2.22 | 2.79 | 2.78 | 2.59 | 2.97 | 2.88 | 2.92 |

TABLE 6-continued (Additional Kymene ® Wet Strength Agent Experiments)

| | Sample: | | | | | | |
|---|---|---|---|---|---|---|---|
| | 7 | 8 | 9 | | 10 | 11 | |
| (CD TEA/CD Tensile) * 1000 | 3.96 | 4.72 | 4.32 | 4.33 | 4.86 | 5.00 | 4.93 |
| CD Slope (kg) | | 0.73 | 0.742 | 0.74 | 0.68 | 0.68 | 0.68 |

With the tensile strengths closer, the improvements in CD properties due to the registered-spray roll application become more apparent. For example, both wet CD stretch and the wet CD TEA/CD tensile ratio are significantly improved over wet-end addition codes of similar tensile strength.

Finally, it should be noted that for all three chemicals evaluated, the registered-spray roll technique yielded an improvement in "pilling". Pilling is an undesirable sloughing off of bits of the sheet when rubbed. For all three chemicals, the pilling was lower for the registered-spray roll codes than for the wet-end addition codes. This is another demonstration of the usefulness of the registered-spray roll technique, since reduced pilling may indicate higher sheet durability to the consumer.

It will be appreciated that the foregoing examples, given for purposes of illustration, are not to be construed as limiting the scope of this invention, which is defined by the following claims and all equivalents thereto.

We claim:

1. A method of treating a semi-dry tissue web comprising:

(a) passing the semi-dry tissue web over a rotating hollow roll having a shell with a pattern of openings therein, the roll rotating at a speed about equal to the speed of the web; and (b) spraying a papermaking chemical from within the hollow roll and outwardly through the openings in the shell, whereby the papermaking chemical is deposited onto the semi-dry tissue web in a pattern.

2. The method of claim 1 wherein the papermaking chemical is a softening agent.

3. The method of claim 1 wherein the papermaking chemical is a debonder.

4. The method of claim 1 wherein the papermaking chemical is a strength agent.

5. The method of claim 1 wherein the papermaking chemical is an absorbency additive.

6. The method of claim 1 wherein the amount of the papermaking chemical deposited on the tissue web, expressed as a percent solids based on dry fiber, is from about 0.004 to about 5 weight percent.

7. The method of claim 1 wherein a gap is present between the tissue web and the shell, said gap being from about 0.03 to about 2 inches.

8. The method of claim 1 wherein the pattern of openings in the shell is a discrete pattern.

9. The method of claim 1 wherein the pattern of openings in the shell is a semi-continuous pattern.

10. The method of claim 1 wherein the openings in the surface of the roll have a pattern density of from about 0.5 to about 20 openings per square inch and the openings have an open area of from about 0.01 to about 1 square inch.

11. The method of claim 1 wherein the wet cross-machine direction stretch (wet CD stretch) of the web is increased.

12. The method of claim 11 wherein the wet CD stretch is increased from about 10 to about 30 percent, on a relative basis.

13. The method of claim 1 wherein the ratio of the wet cross-machine direction tensile energy absorbed (wet CD TEA) divided by the wet cross-machine direction tensile strength (wet CD tensile) is increased.

14. The method of claim 13 wherein the wet CD TEA/CD tensile strength ratio is increased from about 10 to about 30 percent.

15. The method of claim 1 wherein the semi-dry tissue web has a consistency of about 15 to about 50 percent.

16. The method of claim 1 wherein the semi-dry tissue web has a consistency of about 20 to about 30 percent.

* * * * *